United States Patent [19]

Bredemus

[11] 4,241,888

[45] Dec. 30, 1980

[54] DOOR LATCHING MECHANISM

[76] Inventor: Leonard N. Bredemus, 661 E. Belmont La., St. Paul, Minn. 55117

[21] Appl. No.: 44,852

[22] Filed: Jun. 4, 1979

[51] Int. Cl.[3] ..... E05C 1/16

[52] U.S. Cl. ..... 292/165

[58] Field of Search ..... 292/169–169.23, 292/340, 173, 165, DIG. 44

[56] References Cited

U.S. PATENT DOCUMENTS

| | | | |
|---|---|---|---|
| 423,493 | 3/1890 | Scofield | 292/DIG. 44 |
| 2,587,167 | 2/1952 | Kelley | 292/340 X |
| 3,095,225 | 6/1963 | Domsic et al. | 292/340 X |
| 3,999,411 | 12/1976 | Kambic | 292/165 X |

*Primary Examiner*—Richard E. Moore

*Attorney, Agent, or Firm*—Jacobson and Johnson

[57] ABSTRACT

A single swing door is at least temporarily converted to a double swing door by providing means for withdrawing the latch bolt sufficiently out of the latching recess in the door frame so it is beyond striking either edge of the strike plate in the door frame so that the door can be swung open in either direction.

11 Claims, 3 Drawing Figures

DOOR LATCHING MECHANISM

BACKGROUND OF THE INVENTION

While in general it is desirable, and sometimes even required, that in most buildings the room doors swing only one way, usually inward, there are many instances when it is desirable and even mandatory to be able to convert a single swing door at least temporarily into a double swing door. A typical example is in the case of toilet doors in a hospital or in a public building in which generally, for ambulatory cases, the doors need only swing one way, preferrably inward, yet should be made to accommodate nonambulatory cases, such as wheelchair patients, by having the doors possible to swing outward. This is to make it easier for a wheelchair patient to gain access to the room and manipulate the wheelchair. There are doors which have mechanical stops along the door frame which, when desired to convert to a double swing door, are pushed back with one hand and the door swung outward. These are generally awkward to operate especially by wheelchair patients and, in the case of the elderly, might be difficult to operate. Other devices for converting to double swing action are usually lacking in their ability to maintain the privacy that the party still wants to have after he enters the room. In other words, some of the mechanisms for double swing operation are such that the door can be swung open outwardly even though someone is inside the room.

SUMMARY OF THE INVENTION

The instant invention provides for at least temporarily operating a single swing door in a double swing fashion utilizing mechanisms and operating knobs or turnpieces in their usual fashion so as not to require any extra fanciful or any complex operating instructions. The strike plate in the door frame has one edge offset from the other so that in the normal operating fashion the latch bolt is withdrawn out of the opening in the strike plate just far enough to pass beyond the offset edge, usually towards the inside of the room, so that the door can be swung in that direction only. The latch bolt is prevented from being withdrawn or retracted past the other edge of the strike plate so any attempt to swing the door in the opposite direction is frustrated. When needed, however, mechanism is provided to at least temporarily remove the limitation on the retraction of the latch bolt so that it can be withdrawn beyond the other edge of the strike plate opening to permit the door to be swung out in the other direction. As a special feature of the invention, more than a single turn piece can be provided to make the double swing action possible. This serves as a safety feature in the event it is necessary to gain access to the room when there is a problem to open the door by swinging it inward. As another feature, in general, the invention provides for the conversion to double swing action to be on a one shot basis so that after the latch mechanism is operated to swing the door in the other than usual direction, it automatically returns to a single swing action and the user must again selectively convert it back to double swing action, if desired.

DESCRIPTION OF THE INVENTION

Figure 2:
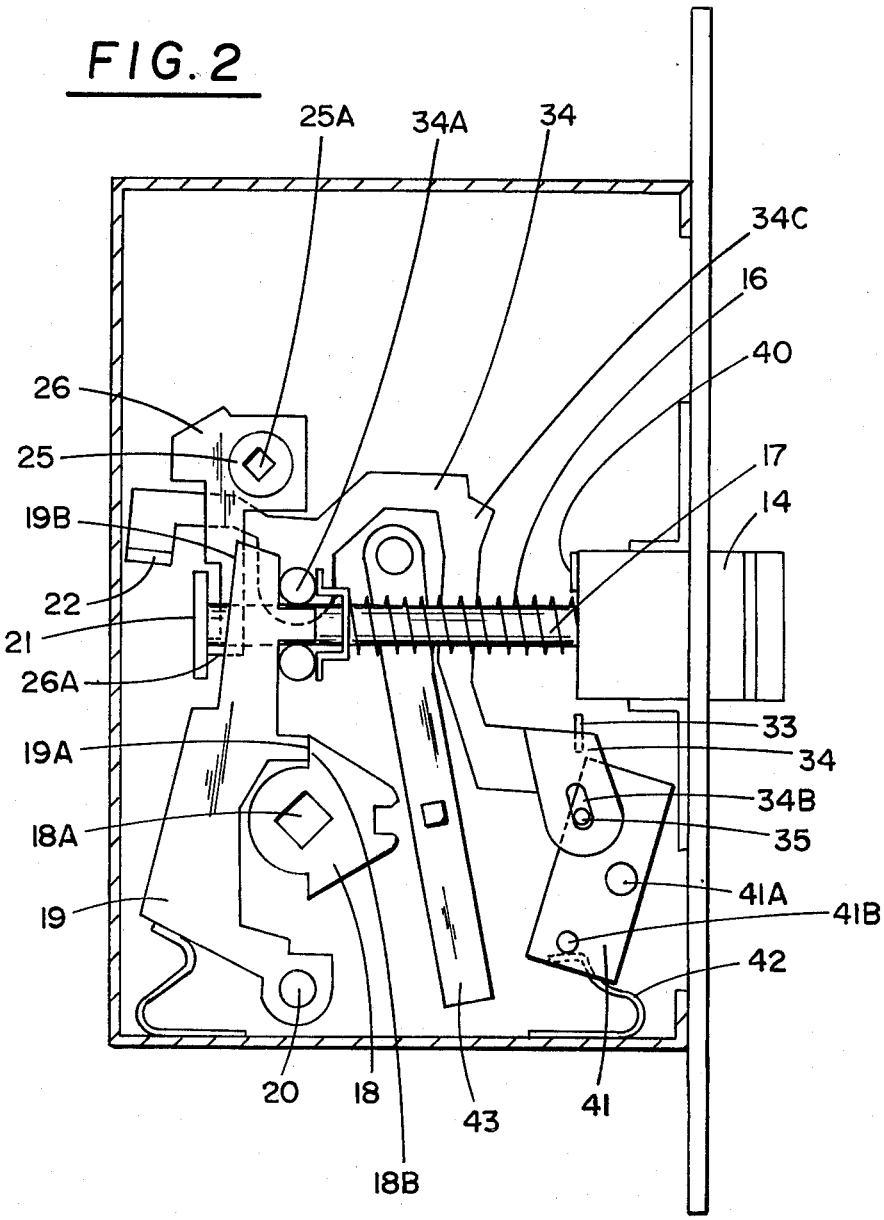
FIG. 2 is a cutaway view showing the various mechanisms used in the preferred embodiment of the invention.

A door frame 10 contains a recess 11 covered over in part by a strike plate 12 having an opening 13 to receive a latch bolt 14 carried by door 15. One edge 12A of the strike plate opening is offset inward into the door frame from the other edge 12B. In normal operation, the latch bolt 14 is being urged by spring action into recess 11 through strike plate opening 13. To open the door the latch bolt is withdrawn by a turn piece, such as a knob, not shown, out of the recess 11 beyond edge 12A but not beyond edge 12B. The door can then be swung inward past edge 12A and the latch bolt 14 rides over hump 12C on the strike plate. The door cannot be swung outward because the latch bolt 14 strikes the other edge 12B of the strike plate opening.

Turning next to FIG. 2, the latch bolt 14 is urged by spring 16 around the latch bolt rod 17 towards the latching recess 11 through the strike plate opening 13. In conventional fashion, a turn piece such as a door knob, not shown, having a suitably structured rod inserted in the opening 18A of knob hub 18 when turned causes retractor lever arm 19 to swing about its pivot point 20 by shoulder 18B of knob hub 18 pushing against the extension 19A. Near its upper edge retractor lever arm 19 rests against the latch bolt rod shoe 21 which is attached rigidly to the rear of latch bolt rod 17. The retractor lever arm 19 swinging counterclockwise about its pivot point 20 retracts or withdraws the latch bolt 14 against the action of the spring 16. The limit of travel of the retractor lever arm 19 and correspondingly the latch bolt 14 is reached when the top end 19B strikes against stop 22. The design is such that this will be far enough to allow the latch bolt 14 to go beyond the offset edge 12A of the strike plate opening but not beyond edge 12B. This then permits the door to be swung conventionally in a single direction.

Another turn piece, not shown, with a suitably designed shaft to mate with the opening 25A of turn piece hub 25 is normally located on the outside or corridor side of the door. When it is turned, it causes its associated turn piece retractor lever arm 26 to pivot about the hub 25 so that its lower end 26A pushes against the latch bolt rod shoe 21 to retract the latch bolt 14. In this instance, however, the retractor lever arm 26 is designed so that the end arm 26A avoids engaging or striking the stop member 22 so that the latch bolt 14 can be withdrawn beyond the edge 12B of the strike plate and the door can be swung outward into the corridor.

It is contemplated by this invention that a turn piece can be located to be operated from either the inside or outside, or both, at hub 25 and similarly a turn piece such as a knob or the like can be located inside or outside, or both, to operate knob hub 18. Ordinarily, a turn piece may be mounted on the inside of the door concentric with an outside turn piece at hub 25 for the purpose of locking the door from the inside for privacy. It is contemplated that the same turn piece can be used by being spring loaded so that it can be pushed to engage the opening 25A and then to be operated in the same fashion as described above to withdraw the latch bolt far enough past strike plate edge 12B to enable the door to be swung outward.

Figure 3:
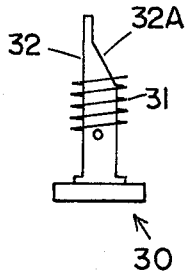
FIG. 3 is a simplified somewhat detailed illustration of a push button mechanism.
Figure 1:
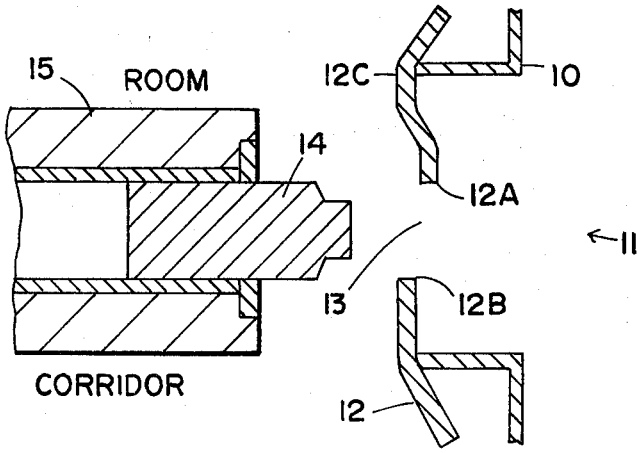
FIG. 1 is a simplified cutaway plan view illustrating the general operation and function of the invention.

To allow the turn piece at knob hub 18 to be used to swing the door outward, a push button 30 (FIG. 3)

which is normally urged outward by spring 31 is inserted so that its plunger 32 slides into slot 33. The tapered end 32A of the plunger 32 pushes against the top of the forward end of restrictor lever arm 34 to move it downward about its pivot point 34A. The stop member 22 is mounted on the far end of restrictor lever arm 34 so that as the latter pivots about its pivot point 34A the former is lifted upward far enough so that it is avoided by the upper section 19B of retractor lever arm 19 when it is moved by turning the turn piece mounted in the opening 18A. In this fashion then, the turn piece can be turned far enough to withdraw latch bolt 14 out of the latching recess 11 beyond edge 12B of the strike plate so that the door can be swung outward into the corridor.

When the latch bolt 14 is withdrawn in this fashion, the latch bolt kickoff 40 attached to the rear of the latch bolt 14 strikes the restrictor lever arm 34 at 34C causing the restrictor lever arm 34 to pivot in the opposite direction about pivot point 34A so that stop member 22 is swung back toward its stop location so that when the latch bolt is released and allowed again to insert into the recess 11 the latching mechanism will now be reset to limit the door to single swing action. The push button will again have to be depressed in order to return it temporarily to a double swing operation by use of the turn plate at hub 18.

In order to permit the push button 30 to be momentarily depressed and then released and still permit double swing action with the turn piece at hub 18 so that the operator can use the same hand to depress the button and then move the turn piece, a mechanism is provided to temporarily latch restrictor lever arm 34 into the position where stop 22 is not in play. A link 41 pivots about pivot point 41A by the action of pin 35 riding in the slot 34B so that the lower part of link 41 swings counterclockwise. A pin 41B carried by link 41 rides against spring 42 which is shaped to hold or latch link 41 in one of two positions. When the push button 30 is depressed, the link 41 acting against the spring 42 will be held in the position whereby the stop 22 is out of the way. When the latch bolt kickoff 40 strikes the restrictor arm 34, the link 41 acting against spring 42 is caused to return to the other condition where stop 20 is back in its stop location.

It should be recognized that the invention contemplates that the push button and associated mechanisms can be located on the inside or the outside of the door or both. It is also contemplated that suitable linkages can be provided to cause the mechanism to operate in the fashion described whether the turn pieces are turned clockwise or counterclockwise.

The elongated bar 43 shown in FIG. 2 is used to lock the latching mechanism to provide privacy. It is not part of the invention but is shown merely to illustrate that the double swing action, as described above, can be achieved and privacy can still be provided.

I claim:

1. Door latching apparatus for operating a normally single swing door as a double swing door, comprising, in combination:

a. a strike plate mounted on the doorway frame having an opening coextensive with a latching recess in the doorway frame, one edge of the strike plate opening being offset from the other edge;

b. a latch bolt slidably mounted within the door normally being extendibly urged to seat in the latching recess;

c. a retractor lever arm coupled to a turn piece and engaging said latch bolt for retracting the latch bolt from the latching recess when said turn piece is turned;

d. stop means for limiting the retracting travel of the latch bolt so as not to be withdrawn beyond the other edge of the strike plate opening; and e. means for retracting the latch bolt while avoiding said stop means for withdrawing the latch bolt beyond the other edge of the strike plate opening.

2. Door latching apparatus as in claim 1 wherein said stop means comprises a stop member normally located to limit the retracting distance the latch bolt is moved, said retractor lever arm being constructed to avoid engagement with the stop member.

3. Door latching apparatus as in claim 1 wherein said stop means comprises a stop member normally located to engage the retractor lever arm to limit the distance the retractor arm withdraws the latch bolt and including means for moving said stop member away from engaging the retractor lever arm.

4. Door latching apparatus as in claim 3 wherein said means for moving the stop member comprises a push button having a plunger for engaging the stop means and moving it away from its location for engaging the retractor lever arm when the button is deressed.

5. Door latching apparatus as in claim 4 including means for yieldably urging said push button plunger away from the stop member when not depressed.

6. Door latching apparatus as in claim 5 wherein said stop member is mounted on a pivotable restrictor lever arm and said plunger engages the restrictor lever arm to swing the stop member away from its location for engaging the retractor lever arm.

7. Door latching apparatus as in claim 4 further including means for moving the stop member back to its location for engaging the retractor lever arm when the latch bolt has been retracted beyond the other edge of the strike plate opening.

8. Door latching apparatus as in claim 6 further including means for pivotally moving the restrictor lever arm to bring the stop member back to its location for engaging the retractor lever arm when the latch bolt has been retracted beyond the other edge of the strike plate opening.

9. Door latching apparatus as in claim 5 further including means responsive to the push button plunger for at least temporarily holding the stop means away from its location for engaging the retractor lever arm after the button has been depressed and released.

10. Door latching apparatus as in claim 9 further including means coupled to the retractor lever arm for releasing the means for temporarily holding the stop means away from its stop location when the latch bolt has been retracted beyond the other edge of the strike plate opening.

11. Door latching apparatus for operating a normally single swing door as a double swing door, comprising, in combination:

a. a strike plate mounted on the doorway frame having an opening coextensive with a latching recess in the doorway frame, one edge of the strike plate opening being offset from the other edge;

b. a latch bolt slidably mounted within the door normally being extendibly urged to seat in the latching recess;

c. a firt manully operable turn piece in the door;

d. a second manually operable turn piece in the door;

e. restrictor means for limiting the retraction of the latch bolt such that the latch bolt cannot be withdrawn beyond the other edge of the strike plate opening;

f. a first retractor lever arm coupled between the first turn piece and the latch bolt located and constructed to avoid said restrictor means whereby the latch bolt can be withdrawn beyond the other edge of the strike plate opening with said first turn piece;

g. a second retractor lever arm coupled between the second turn piece and the latch bolt located and constructed to engage said restrictor means whereby the latch bolt cannot ordinarily be withdrawn beyond the other edge of the strike plate opening with said second turn piece; and h. manually operable means in the door linked to said restrictor means for at least temporarily moving said restrictor means away from its location for engaging the second retractor lever arm whereby the latch bolt can be withdrawn beyond the other edge of the strike plate opening with said second turn piece.

* * * * *